US006968876B2

(12) United States Patent
Yacko et al.

(10) Patent No.: US 6,968,876 B2
(45) Date of Patent: Nov. 29, 2005

(54) APPARATUS FOR DISPENSING A SUBSTANCE

(75) Inventors: R. Bruce Yacko, Toledo, OH (US); Edward L. Mueller, Toledo, OH (US); John A. Wiegand, Sylvania, OH (US); Jeffrey C. Gayer, Sylvania, OH (US); Todd G. Schimmoeller, Ottawa, OH (US)

(73) Assignee: JAWS International, Ltd., Toledo, OH (US)

( * ) Notice: Subject to any disclaimer, the term of this patent is extended or adjusted under 35 U.S.C. 154(b) by 82 days.

(21) Appl. No.: 10/348,646

(22) Filed: Jan. 21, 2003

(65) Prior Publication Data

US 2004/0140013 A1 Jul. 22, 2004

(51) Int. Cl.[7] ..... B67D 5/00

(52) U.S. Cl. ..... 141/361; 141/21; 141/94; 141/104; 141/192; 141/231; 141/351

(58) Field of Search ..... 141/2, 9, 18, 21, 141/94, 98, 100, 103, 104, 192, 231, 351, 141/360, 361

(56) References Cited

U.S. PATENT DOCUMENTS

| | | | | |
|---|---|---|---|---|
| 3,103,960 | A * | 9/1963 | Simjian | 141/160 |
| 4,929,818 | A | 5/1990 | Bradbury et al. | 235/381 |
| 5,040,699 | A * | 8/1991 | Gangemi | 222/1 |
| 5,203,387 | A * | 4/1993 | Howlett et al. | 141/103 |
| 5,566,732 | A | 10/1996 | Nelson | 141/94 |
| 5,765,605 | A * | 6/1998 | Waymire et al. | 141/100 |
| 6,193,058 | B1 | 2/2001 | Yacko et al. | |
| 6,364,105 | B1 | 4/2002 | Yacko et al. | |
| 6,578,763 | B1 | 6/2003 | Brown | 235/435 |
| 2002/0030102 | A1 * | 3/2002 | Brown | 235/435 |
| 2003/0051767 | A1 | 3/2003 | Coccaro et al. | 141/351 |

FOREIGN PATENT DOCUMENTS

| | | |
|---|---|---|
| EP | 0725035 A1 | 7/1996 |
| WO | 02/42199 | 5/2002 |
| WO | 03/024814 | 3/2003 |
| WO | 03/086952 | 10/2003 |
| WO | 03/095354 | 11/2003 |

* cited by examiner

*Primary Examiner*—J. Casimer Jacyna
(74) *Attorney, Agent, or Firm*—MacMillan, Sobanski & Todd, LLC

(57) ABSTRACT

A container filling apparatus includes at least one source container that contains a substance and a reading mechanism capable of reading data from a data indicator on a receiving container wherein the data indicator identifies data about the receiving container. The apparatus also includes a controller that is connected to the reading mechanism. The controller is programmed to determine when a dispensing condition is satisfied. The apparatus also has a dispenser for discharging the substance into the receiving container in response to a signal from the controller. The dispensing condition can be a match between data from the data indicator and the data stored for access by the controller. The source container can also have a data indicator. The dispensing condition is then satisfied when the data from the source container data indicator matches the data from the receiving container data indicator.

44 Claims, 5 Drawing Sheets

APPARATUS FOR DISPENSING A SUBSTANCE

TECHNICAL FIELD

This invention relates to a system for efficiently dispensing substances such as liquids, solids or powders. More particularly, this invention pertains to a system for efficiently dispensing substances such as chemical solvents and cleaners, of that type that are advantageously or preferably controllably dispensed in measured doses.

BACKGROUND OF THE INVENTION

Industrial and commercial firms frequently require the use of industrial solutions, including cleaning solutions, disinfectant solutions and solvents for various purposes. In hospitals, for example, disinfectant solutions are often used on floors and other surfaces to assure a clean environment. Traditional technology for disbursing and handling these industrial solutions typically involves shipping the solution in bulk to the facility requiring the solution, and measuring out quantities of the solution for each use required. This system is disadvantageous in that it requires the shipping and storing of a large amount of bulky, heavy fluid. Alternatively, concentrated chemical sources can be shipped in smaller portions, but the end users are responsible for handling and diluting the chemicals, which are expensive, and, if handled, could be dangerous.

Advances in the field of disbursing solutions have lead to the use of concentrates dispensed from a central location for dilution and use in various locations within an industrial or commercial facility. The concentrates can be either in a liquid or a solid form. The use of concentrates is an improvement over shipping fully diluted solutions, which require large storage units and take up valuable space in a hospital or factory, for example. In large industrial and commercial facilities a concentrate dispensing system would therefore require either multiple dispensing locations or repeated trips over large distances to return to the dispensing location for refilling individual dispensing containers.

The use of such a dispensing system also potentially places the responsibility of dispensing the materials on untrained personnel. Further, it then becomes the user's responsibility to know which chemicals can be mixed together and in which proportions. Leaving such choices to the discretion of a user creates the opportunity for the improper and potentially dangerous combination of chemicals, the waste of expensive chemicals or the theft thereof. Additionally, in the food service and pharmaceutical industries, the dispensing of accurate amounts of ingredients is essential to quality control and inventory management.

The use of a chemical mixing and dispensing station is known, as disclosed in U.S. Pat. No. 4,976,137 to Decker et al. The apparatus includes a blending unit having a manifold, a plurality of chemical inlet ports, a water inlet port, and an outlet port. A plurality of pumps and valves are connected with the chemical inlet ports. The outlet port is connected to dispensing outlets for dispensing the chemical solutions into a container. The apparatus also uses an electronic control unit to operate the system at a pre-selected volume, in sequential combination and control the concentration of chemicals.

It would be advantageous if a system could be developed for more simply handling, dispensing and diluting concentrated materials. Such a system would preferably allow the user of the concentrated materials to avoid touching or contacting the concentrate.

SUMMARY OF THE INVENTION

This invention relates to a container filling apparatus that has at least one source container containing a substance, a reading mechanism capable of reading data from a data indicator on a receiving container wherein the data indicator identifies data about the receiving container. A controller is connected to the reading mechanism wherein the controller is programmed to determine when a dispensing condition is satisfied, based on the data from the receiving container, and to generate a signal when the dispensing condition is satisfied. A dispenser is provided for discharging the substance into the receiving container in response to the signal from the controller.

In an alternate embodiment, the invention includes a dispensing apparatus having a plurality of source containers each containing a substance wherein each of the source containers has at least one data indicator containing data. The apparatus also has a reading mechanism that reads the data on the source container data indicators and data from a receiving data indicator on a receiving container for receiving the substance, and transmits the data to a controller. The controller is programmed to process the data received from the source container data indicators and receiving container data indicator, and operates at least one of the source containers to discharge the one or more substance into the receiving container in response to a determination that the data from the receiving container data indicator corresponds to data from the at least one source container data indicator.

In an alternate embodiment, the invention includes a method of dispensing a substance into a receiving container. The steps of the method include reading a data indicator on the receiving container, reading a data indicator on one or more source containers wherein the source containers each contain a substance, operating a controller to determine if the data from the indicator on the source container matches the data from the indicator from the receiving container, and operating a dispensing system to discharge a substance from at least one of the source containers into the receiving container in response to a determination that the source container data indicator corresponds to the receiving container data indicator.

All data can be downloadable via traditional memory devices such as floppy or compact discs, transmitter/receiver devices, or infrared technology to "PALM"™ or similar portable computer peripherals to a main server database. The data will allow for the measurement and management of key statistics.

In an alternate embodiment, the apparatus includes a unit for reading/scanning the data indicators on the various components of the apparatus. This unit can be attached to the apparatus or be hand-held.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
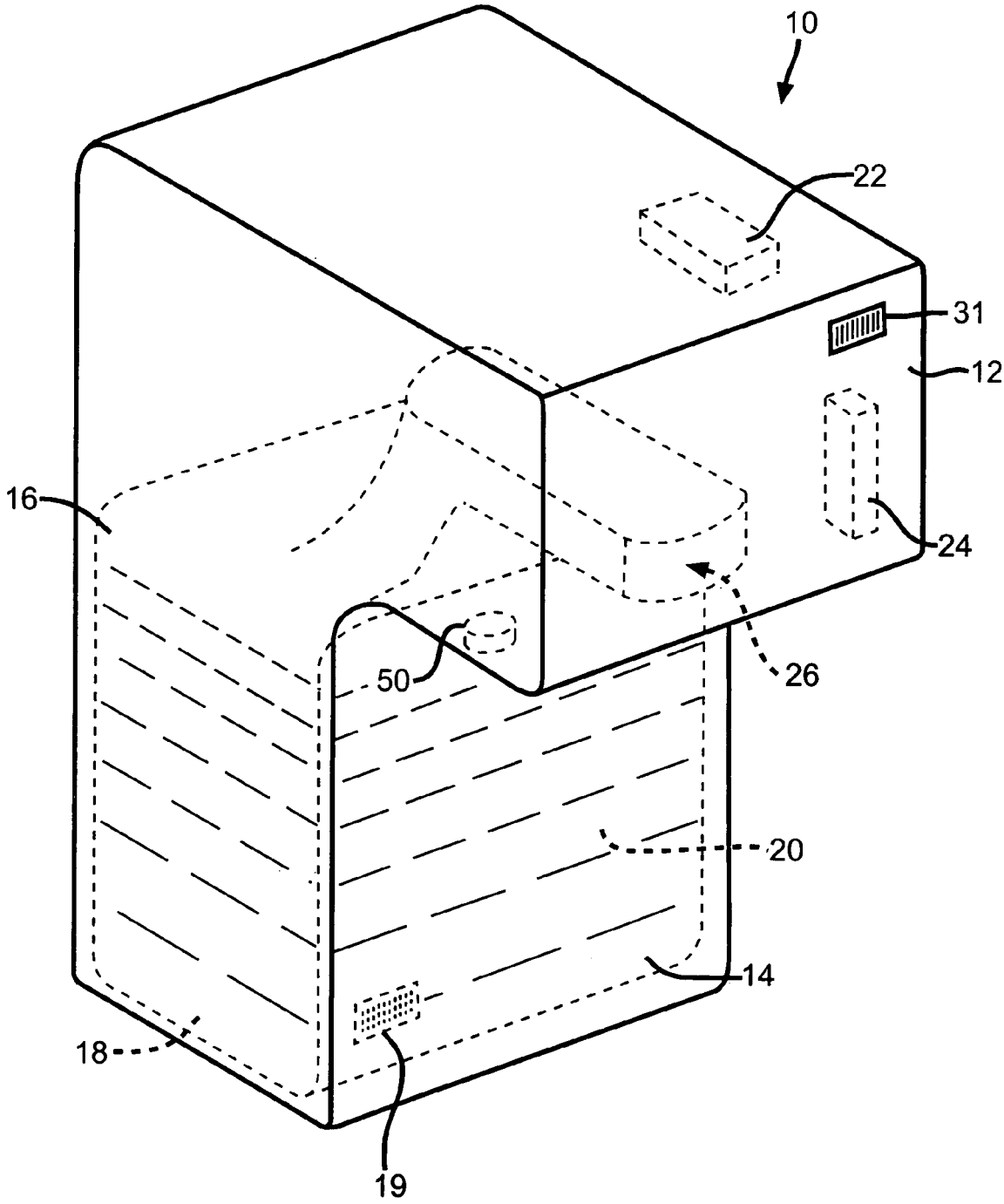
FIG. 1 is a perspective view of a source container dispensing apparatus in accordance with the present invention.

Referring now to the drawings there is illustrated in FIG. 1 a dispensing apparatus 10 for dispensing a substance. The dispensing apparatus 10 as illustrated has an inverted "L" shape, but the apparatus 10 can have any suitable shape or configuration. As shown, the body of the dispensing apparatus 10 has a generally rectangular upper portion 12 and lower portion 14. The lower portion 14 can act as a base and preferably has a cavity 16 formed therein such that a source container 18 can be positioned inside the apparatus 10. However, it should be understood that the source container 18 could be positioned at any suitable location within or without the apparatus 10. Additionally, the dispensing apparatus 10 could be adapted to have any size or shape. Therefore, the source container 18 could also have any size or shape, wherein the size or shape of the container 18 corresponds to or can be connected to the apparatus 10. Alternatively, the source container 18 could be smaller than the cavity 16 of the apparatus 10 so that multiple source containers 18 could be positioned therein. The source container 18 preferably contains a substance 20 that is to be dispensed from the dispensing apparatus 10. When the contents 20 of the source container 18 have been depleted, the apparatus 10 could be opened, and the source container 18 replaced or refilled. In a preferred embodiment, the source container 18 is a replaceable cartridge. The upper portion 12 of the dispensing apparatus 10 preferably has the capacity to receive a control device or controller 22, a reading mechanism 24 and a dispenser 26. The dispenser 26 of the apparatus, preferably located on the underside of the upper portion 12 of the dispensing apparatus 10, can include a nozzle, valve or tap (not shown). The dispenser 26 can be connected to the source container 18 in any manner such that when the dispenser 26 is activated, the dispenser 26 can discharge a substance 20 from the source container 18. Various appurtenances can also be attached to the body of the dispensing apparatus 10 such as a hose connected to the dispenser 26 or a mechanism to allow the apparatus 10 to be connected to receiving vessel, such as an a mop bucket 28, a maid/maintenance cart, not shown, an auto scrubber, not shown.

The control device or controller 22 of the dispensing apparatus 10 is preferably a microchip, a computer or any other controlling device that acts as a controller for the apparatus 10. The controller 22 operates a program that can be enabled to control how and when the apparatus 10 dispenses the substance 20 from the source container 18. It is preferred that the controller 22 be programmed such that the dispenser 26 can only be activated when the controller 22 allows the dispenser 26 to operate, regardless of whether an operator attempts to operate the dispenser 26. Therefore, it is preferred that the controller 22 be connected to the dispenser 26. It is also preferred that the controller 22 be connected to the reading mechanism 24, which can be an RF (radio-frequency) receiver, a bar code scanner, a magnetic strip reader, a fingerprint reader, a retinal scanner, or any other suitable reading mechanism that is capable of reading data on sources of data. Sources of data can include data indicators 19, 30, 31, which are preferably attached to the dispensing apparatus 10, the source container 18 and a receiving container 32, as shown in FIG. 3.

Figure 2:
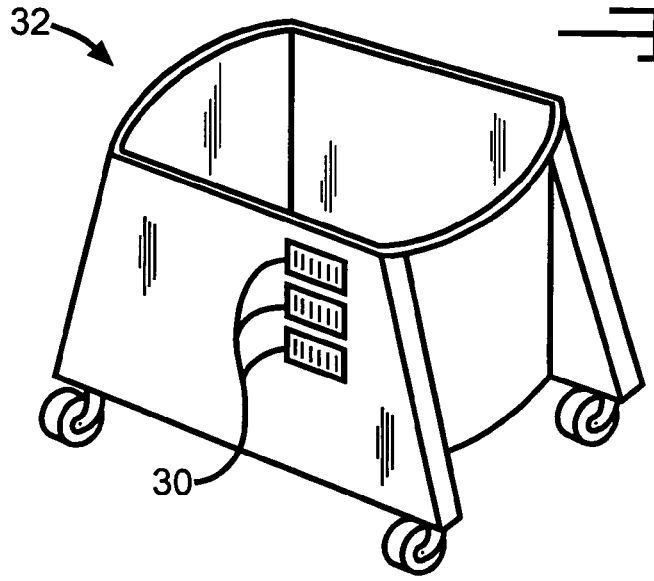
FIG. 2 is an enlarged perspective view of a first receiving container.

As illustrated in FIG. 2, the first example of a receiving container 32 is a conventional mop bucket. The bucket 32 can have any volume, shape or size, but it is preferred that the bucket 32 be appropriately sized such that a mop head or any other type of brush can be positioned inside the bucket 32 to gain access to the materials contained therein. Positioned on the bucket 32, preferably at a convenient location such as on the top of one of the sides or on at least one of the sides, is at least one data indicator 30 for providing information about the bucket 32. As described above, the dispensing apparatus 10 can be adapted to be mounted with the bucket 32 so that the substance 20 to be dispensed can be easily discharged into the receiving container 32.

Figure 3:
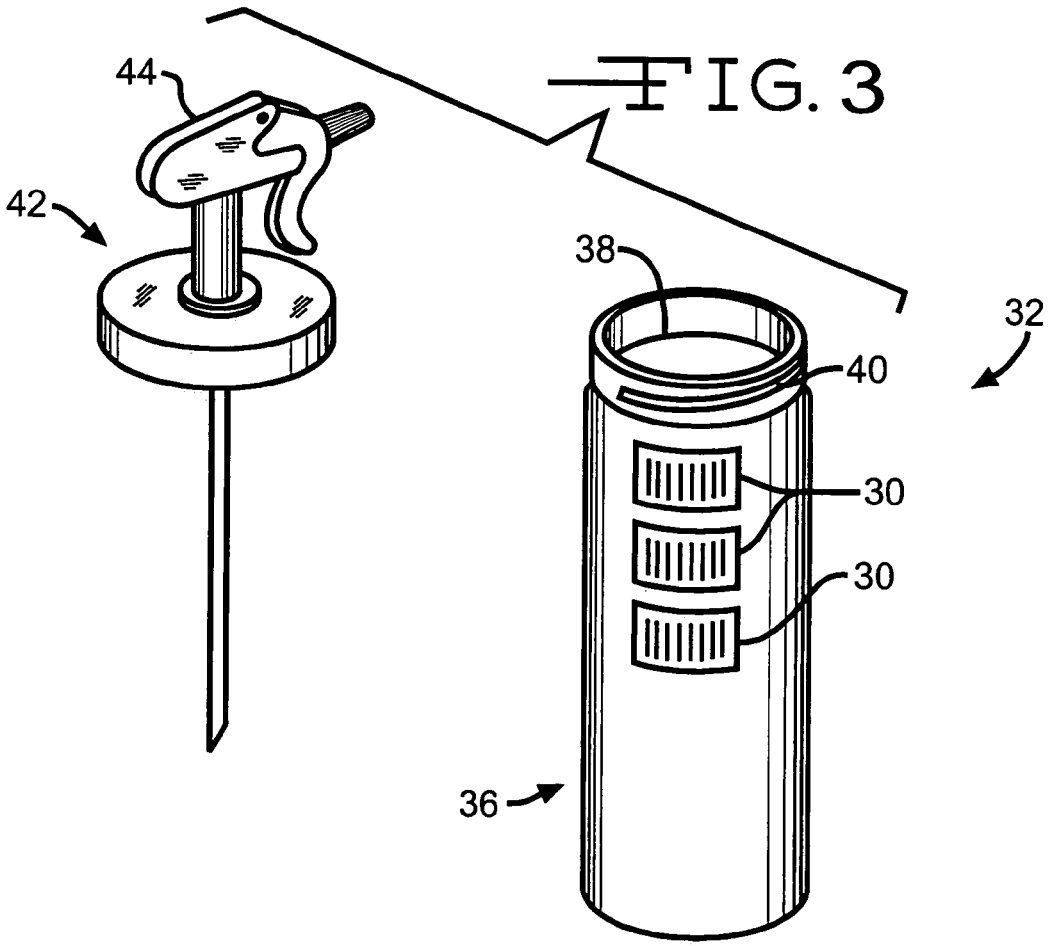
FIG. 3 is an enlarged perspective view of a second receiving container.

Shown in FIG. 3 is a second example of a receiving container in the form of a spray bottle 32 having a cylindrical body 36 with an opening 38 at the top end. The top end also preferably has threads 40 that mate with a corresponding cap 42. The threads 40 could also be used to position the bottle 32 with respect to the dispensing apparatus 10. The cap 42 preferably includes an apparatus that allows for easy discharge of the fluid from the bottle 32, such as a trigger sprayer 44. Positioned on the body 36 of the bottle 32, preferably at a convenient location, is at least one data indicator 30. Although two embodiments of receiving containers have been illustrated, it should be understood that any suitable receiving container could be used with the dispensing apparatus 10 of the present invention.

The reading mechanism or reader 24 is adapted to read the data indicators 30. Depending on the reading mechanism 24, the data indicator 19, 30 could be an RF chip (or transmitter), a bar code, a magnetic strip, or any other data indicator that corresponds to the type of reader 24 that is being used. The data contained on the data indicators 19, 30 preferably includes data about the source container 18 or receiving container 32. The source container data indicator 19 can contain data identifying the substance 20 contained within the source container 18, the amount of the substance 20 that is to be dispensed, the frequency with which the substance 20 can be dispensed, the operating personnel that are permitted to dispense the substance 20, or any other information about the substance 20 or accessibility to the substance. The amount of substance 20 to be dispensed can be based on the actual volume of substance 20 dispensed, on the amount of time the dispenser 26 remains open, or any other suitable measuring parameter. The receiving container data indicator 30 can contain data identifying the substance 20 (or substances) that the container 32 is capable of receiving, the amount of the substance 20 that is to be received, the frequency with which the receiving container 32 can receive the substance 20, who can fill the receiving container 32, or any other desired information about the receiving container 32.

Figure 4:
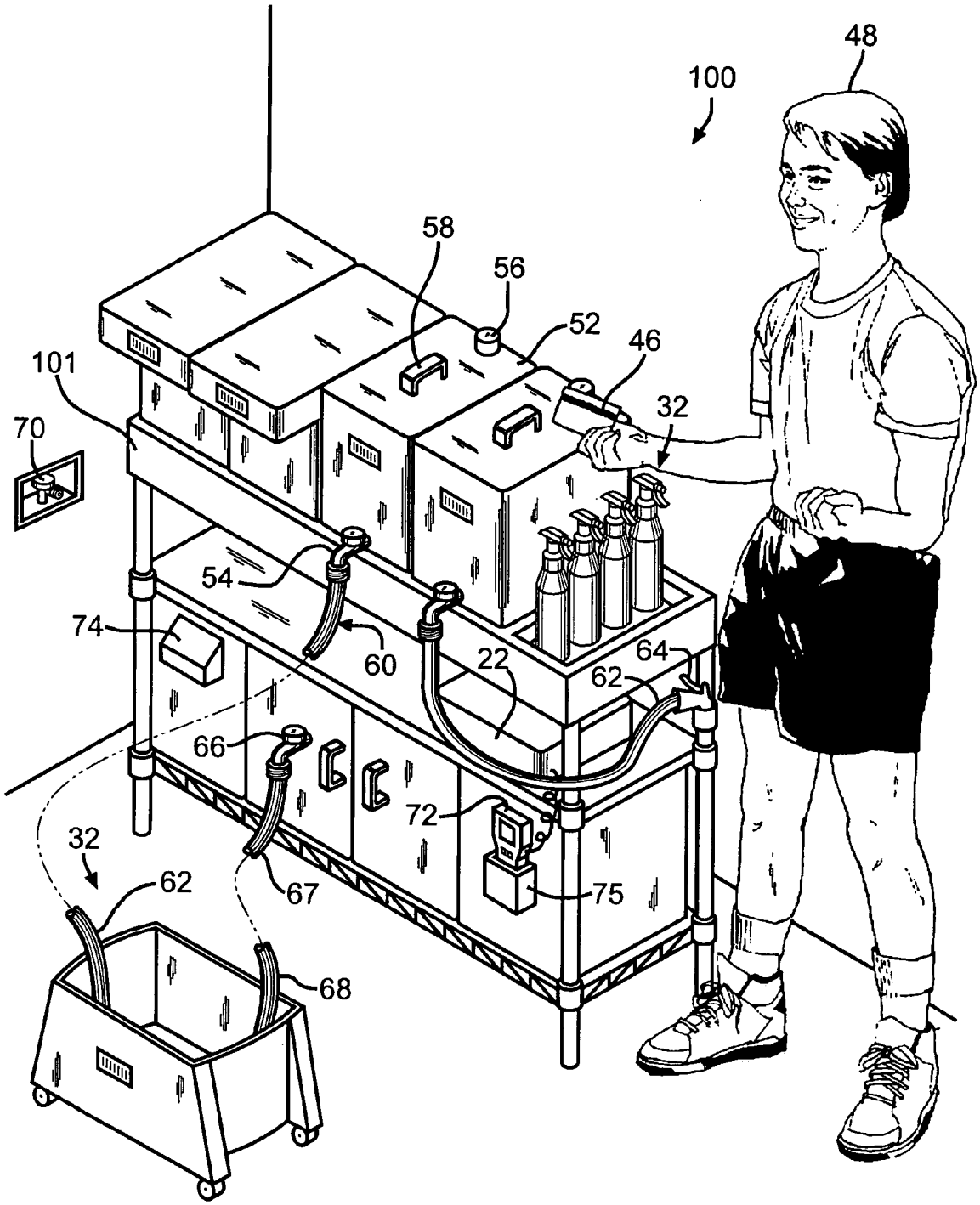
FIG. 4 is a perspective view of an alternate embodiment of a dispensing apparatus in accordance with the present invention.

The controller 22 is preferably programmed such that when certain dispensing conditions are met, the controller 22 will allow the dispenser 26 to discharge an amount of the substance. The dispensing conditions are preferably based on the data that is contained on the data indicators 19, 30. Particularly, the controller 22 could allow the dispenser 26 to activate when the receiving container data indicator 30 is read by the reading mechanism 24 and is a match to a pre-established condition. For example, an RF chip on the receiving container 32 would register with an RF reading mechanism on the apparatus 10 and indicate that the receiving container 32 is the correct container to receive the substance 20 contained in the apparatus 10 (and the source container 18). Alternatively, the receiving container data indicator 30 could be a bar code and the reading mechanism 24 could be a bar code scanner. If the bar code that is read by the scanner matches a code programmed within a database in the program of the controller 22, the controller 22 would allow the dispenser 26 to activate. Additionally, a data indicator 19 could be located on the source container 18 as well. The reading mechanism 24 could then be used to read both the source container data indicator 19 and the receiving container data indicator 30. If the control program detects that both the source data indicator 19 and receiving data indicator 30 correspond to each other the controller 22 would then allow the dispenser 26 to activate. Other dispensing conditions could include a data indicator match between the source 18 and receiving containers 32, and a match between the source or receiving container data indicators 19, 30 and a personnel identification indicator 46, as shown in FIG. 4 where the person 48 is illustrated holding the indicator 46. The personnel identification indicator 46 is a data indicator that contains information about the person 48 attempting to operate the apparatus 10. A plurality of data indicators 19, 30 could be affixed to the source container 18 and receiving container 32 thereby allowing multiple substances 20 to be dispensed, respectively, from or into a container 18, 32. Although it has been described that the source data indicators 19 and the receiving data indicators 30 "match", it should be understood that the term "match" can include any type of correspondence which permits the program of the controller 22 to recognize that a dispensing condition is satisfied thus authorizing activation of the dispenser 26.

It is preferred that the controller be programmed to process the information from the data indicators 19, 30, 46 to determine whether the dispensing conditions are satisfied. Therefore, the control program can receive information from the reading mechanism 24, process the received data and determine whether to activate the dispenser 26 based on the data received. For example, based on data from the data indicators 19, 30, the control program can identify the amount of the substance 20 that is to be dispensed from the source container 18 and the amount of substance 20 to be received in the receiving container 32 and determine whether there is a match between the data indicators 19, 30. Additionally, the controller 22 can be programmed to record the amount of substance 20 discharged per operation of the dispenser 26, the number of receiving containers 32 processed, the frequency with which receiving containers 32 are filled, the operator 48 of the apparatus 10, and the time of day the apparatus 10 is accessed. To prevent theft or waste, the program of the controller 22 can also detect and record whether an operator 48 of the apparatus 10 attempted to dispense a substance 20 at a frequency that exceeds an allowable amount, into an unauthorized container, in a greater amount than permitted, whether an unauthorized operator attempted to use the apparatus 10, who operates the apparatus 10 and when it is operated. It can be appreciated that the controller 22 can be programmed to include a greater or lesser number of parameters, including any other suitable types of information desired to be detected and recorded by the users of the apparatus 10.

In an alternate embodiment, the apparatus 10 has a locating mechanism 50 that can determine whether the receiving container 32 is properly positioned with respect to the dispenser 26 or source container 18. This is to prevent the substance 20 from being dispensed while the receiving container 32 is not appropriately placed. The locating mechanism 50 can be a movable tab that authorizes or enables the dispenser 26 when displaced by the receiving container 32. In a preferred embodiment, the locating mechanism 50 is an optical or infrared scanner. It is further preferred that the locating mechanism 50 also be connected to the controller 22 so that the controller 22 can prevent the dispensing of the substance 20 if the scanner 50 sends a signal to the controller 22 indicating that the receiving container 32 is improperly positioned. Alternatively, the dispensing apparatus 10 can be adapted to lockingly receive the receiving container 32 by using a threaded attachment or snap-in mechanism. Then, the locating mechanism 50 could detect the position of the receiving container 32 and notify the controller 22 that a container 32 is in the proper position for dispensing. The controller 22 could then check the data indicator 30 to ensure that the receiving container 32 is the proper one and that any other dispensing condition is also satisfied prior to activating the dispenser 26 to dispense the substance 20. In an alternate embodiment, the dispensing apparatus 10 could include a combination of the sensors described above and have an actuator such that when the data and position indicators verify that a data and position match has occurred, the operator of the apparatus 10 can depress a button to trigger the apparatus 10 to dispense the substance 20.

Illustrated in FIG. 4 is an alternate embodiment of the invention having a dispensing station, indicated generally at 100. The dispensing station 100 includes a dispensing apparatus 10 as described above, and preferably a plurality of dispensing apparatuses. However, each source container 18 could act directly to dispense a substance 20. For example, a source container could be a generally hollow container 52, such as a tank, having an independent outlet 54 or dispenser. Each container 52 could be filled with a liquid, solid or powder material. The dispenser 54 could include any type of release mechanism such as a spigot, valve, faucet, tap, or nozzle. The source container tanks 52 could optionally have an inlet 56 in order to allow for refilling of the container 52. Preferably, the containers 52 are made of a generally clear material so that the quantity of the substance 20 remaining therein is easily discernable by observing the outside of the container 52. Additionally, the source containers 52 are preferably sized to have a multi-gallon capacity. However, the containers 52 can have any size or shape and can be made of any material. The source container tanks 52 can also optionally have handles 58, multiple outlets or inlets, feet or any other appurtenances suitable for use with source containers. Any other suitable source containers, such as jugs, bags or lined boxes may also be used with the present invention. Attached to each outlet 54 of the source container 52 could be a spigot or a flexible hose 60 such that one end of the hose 60 is connected to the outlet or spigot 54 and the other, dispensing end 62 is adapted to be positioned in or above a receiving container 32. At the dispensing end of the hose 62, there can optionally be a dispenser such as a trigger sprayer 64, tap or nozzle. Alternatively, each source container 18, 52 can dispense directly into a receiving container 32 from the spigot or outlet 54.

The receiving containers 32 can contain water or another diluent prior to receiving the substance. However, pre-filled containers are not required; a diluent can be added to the receiving container 32 after the container receives the substance 20. The receiving container 32 carrying a solution of the substance 20 and diluent can then be used at any location such as a different room, floor, or building as needed. Alternatively, a diluent could be connected to the source container 52 such that upon activation of the dispenser 54, the diluent mixes with the discharge of the source container 52 prior to being dispensed into the receiving container 32. The mixing could be done in a separate chamber or in the hose connecting the source container 52, diluent source 66 and the receiving container 32. Additionally, a plurality of source containers 18, 52 could be connected to a mixing chamber and mix a plurality of substances 20 (including a diluent) prior to discharging a mixture of substances into the receiving container 32.

The source containers 18, 52 are preferably positioned at a dispensing station 100. The dispensing station 100 preferably includes a cart 101 that is optionally mounted on wheels. This would allow the station 100 to be positioned at a central location or moved as needed. In an alternate embodiment, the station 100 can be a permanent, unmovable structure. The source containers 18, 52 can be loosely positioned on or securely fastened to the cart 101 such that they can be refilled, removed, or replaced as needed. The station 100 can also include a hose 67 that is attachable to a diluent source 66 on one end with a nozzle attached to a dispensing end 68. The diluent source can be a permanent source, such as a wall outlet 70, water tap or sink, or a movable source, such as diluent tank 66 supplied on the station 100 or a loose tank (not shown). The dispensing end 68 of the diluent hose 67 is preferably adapted to dispense water or another diluent into the receiving container 32 with ease and efficiency.

Figure 5:
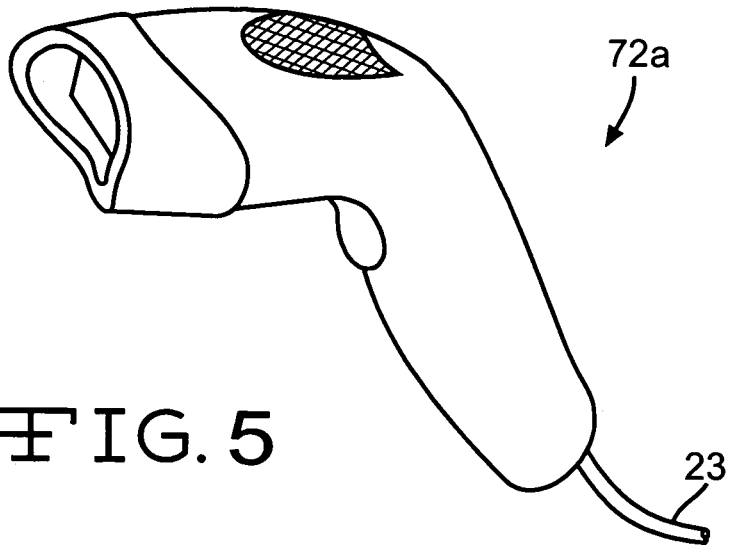
FIG. 5 is an enlarged view of a first handheld reading device.
Figure 6:
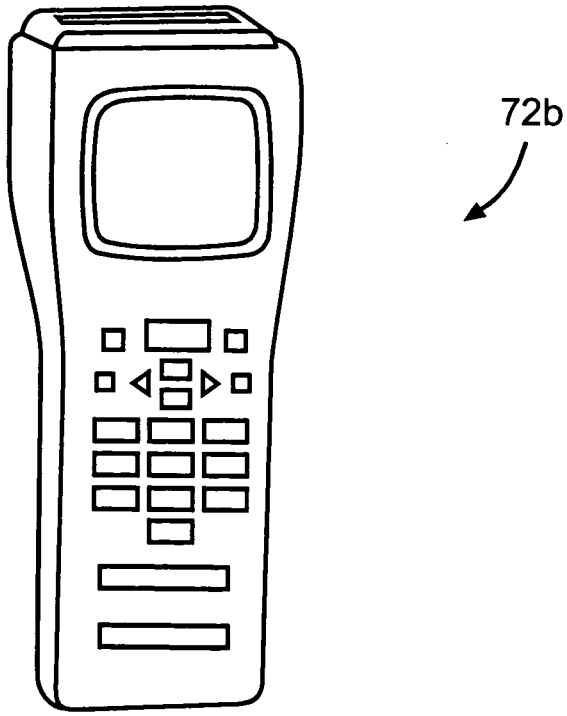
FIG. 6 is an enlarged view of a second handheld reading device.

For safety and cost reasons, it is preferred that only a specified amount of the substance 20 be dispensed into a particular receiving container 32. As described above, the operation of the dispensing apparatus 10, 54 can be managed by programming a controller 22 to process data from the data indicators 19, 30. The data indicators 19, 30 on the receiving container 32 and source container 18, 52 can be a magnetic strip, bar code, colored tag, pre-printed instruction label, or any other identifying indicia. It is preferred that the data indicator 19, 30 be a magnetic strip, bar code or RF system so that a controller 22 operating a data matching and tracking program can determine when and whether a substance 20 is dispensed and thus, removes any potential user confusion. Therefore, it is also preferred that the dispensing station 100 have a reading mechanism 72, 74 such as a magnetic strip reader or scanner device so that the information on the data indicators 19, 30 can be transmitted to the controller 22. The reader 74 can be permanently affixed to the cart as shown in FIG. 4. The receiving container 32 can then be moved to the reader 74 in order to be read. It is preferred that the reader 72 be movable relative to the cart 101. This would allow the reader 72 to be moved toward the item to be read, and thus would be easier to handle by the user. Movable readers 72, such as those shown in FIGS. 5 and 6, are shown as conventional scanning devices. Any suitable scanning/reading device can be used in accordance with the present invention. The handheld reader 72*a* shown in FIG. 5 is preferably adapted to be physically connected to a controller 22 by a cable 23. Many reading devices come with a cable 23 that allows data to be transferred from the reading device 72 to a controller 22. Alternatively, the reading device 72*b* can be wireless, such as the device shown in FIG. 6. If the wireless reading device 72*b* is used, there is preferably a stand or holster 75 of some sort that retains the device 72*b* with the station. Alternatively, a portable reader 72 could be connected to a receiving container 32 such that the reader 72 travels with the receiving container 32.

The controller 22 is preferably attached to the cart 101 of the station 100 and adapted to process the data read by the reader 72, 74 to determine whether a dispensing process should commence. The controller 22 can be programmed similarly to the controller 22 described with respect to the other embodiments of the invention. This can prevent a user 48 from siphoning off or pilfering the substance 20, which in many cases can be very expensive. Therefore, in any of the embodiments described herein, the station 100 or dispensing apparatus 10 can be equipped with an alarm (not shown) so that the person 48 using the station 100 or apparatus 10 and others know when an attempt is made to dispense the substance 20 at a frequency faster than a preset rate. An alarm can also be set for attempts to fill an improper receiving container 32, to dispense from a source container 18 to a non-matched receiving container 32, to dispense a greater than authorized amount of the substance 20, to indicate a lack of pre-filling of the receiving container 32 with diluent, and to operate the apparatus 10 or station 100 in violation of the control program. The controller can be programmed to disable the dispenser to prevent dispensing of the substance when the alarm is sounded. The controller 22 should also be adapted to store in a memory device the data read by the reading mechanism 22, 72, 74. The memory device could be made integrally with the controller 22. The information collected by the controller 22 can be downloaded or transmitted to a central computer or master control device for the purpose of inventory control, use information, ordering information, and quality control. The data is preferably stored in the controller 22 using random access memory, read only memory, or on a transferable or portable memory device such as a CD-ROM, flash-ROM chip, floppy disk, or any other suitable computer memory device (not shown). Alternatively, the controller 22 can transmit the data from a stored medium to another computer, master control device or memory storage device via a modem, a plug-in connection to a portable controller, a radio transmitter and receiver system, infrared means (such as via a PALM® operated device or a similar handheld computing device), or any other means. Additionally, the controller 22 could operate as the master control device allowing direct printing or downloading of information from the controller 22.

In a further preferred embodiment, the controller 22 operates a control program that is enabled to determine whether an individual 48 attempting to use the apparatus 10 or station 100 is authorized to do so. This is to prevent theft or misuse of a substance 20 contained in a source container 18 by an untrained individual or a person who should not be accessing the substance. Such a program can be implemented to read a personnel data indicator 46, such as a bar code or magnetic strip, on an individual's nametag, uniform, or personnel identification card 46. Alternatively, more sophisticated systems, such as fingerprint or retinal scanning, can also be used. The reading device for identifying purposes can be the same as the reader 24, 72, 74 for the source container data indicator 19 and receiving container data indicator 30, but a different reader could also be used. It is preferred that the personnel identification reading mechanism be connected to the controller 22 such that the controller 22 can record and track which personnel used the station 100 or apparatus 10, when the station 100 or apparatus 10 was used, and whether an attempt was made to use the station or apparatus improperly. As described above, an alarm (using lights and sound) can be used to indicate to the user 48 and others if someone attempts to access the station 100 or apparatus 10 without authorization or attempts to use it incorrectly.

Although the invention has been described as dispensing a generic substance 20, it is preferred that the apparatus be used for dispensing chemical concentrates or any other liquid into any type of receiving container. The method and apparatus of the invention are particularly adapted for the dispensing of concentrated cleaning chemicals into a diluent-filled dispensing bottle. The method and apparatus of the invention can be used to dispense many other substances including ketchup, soda, and fruit juices as well as non-food substances. Also, the dispensing apparatus could dispense a powder such as hot chocolate powder, instant coffee and lemonade powder. Additionally, the dispensing mechanism 26 could be adapted to dispense any type of substance, including solids and powders, such as prescription pills, pesticides or any other material where measured dispensing is advantageous.

Figure 7:
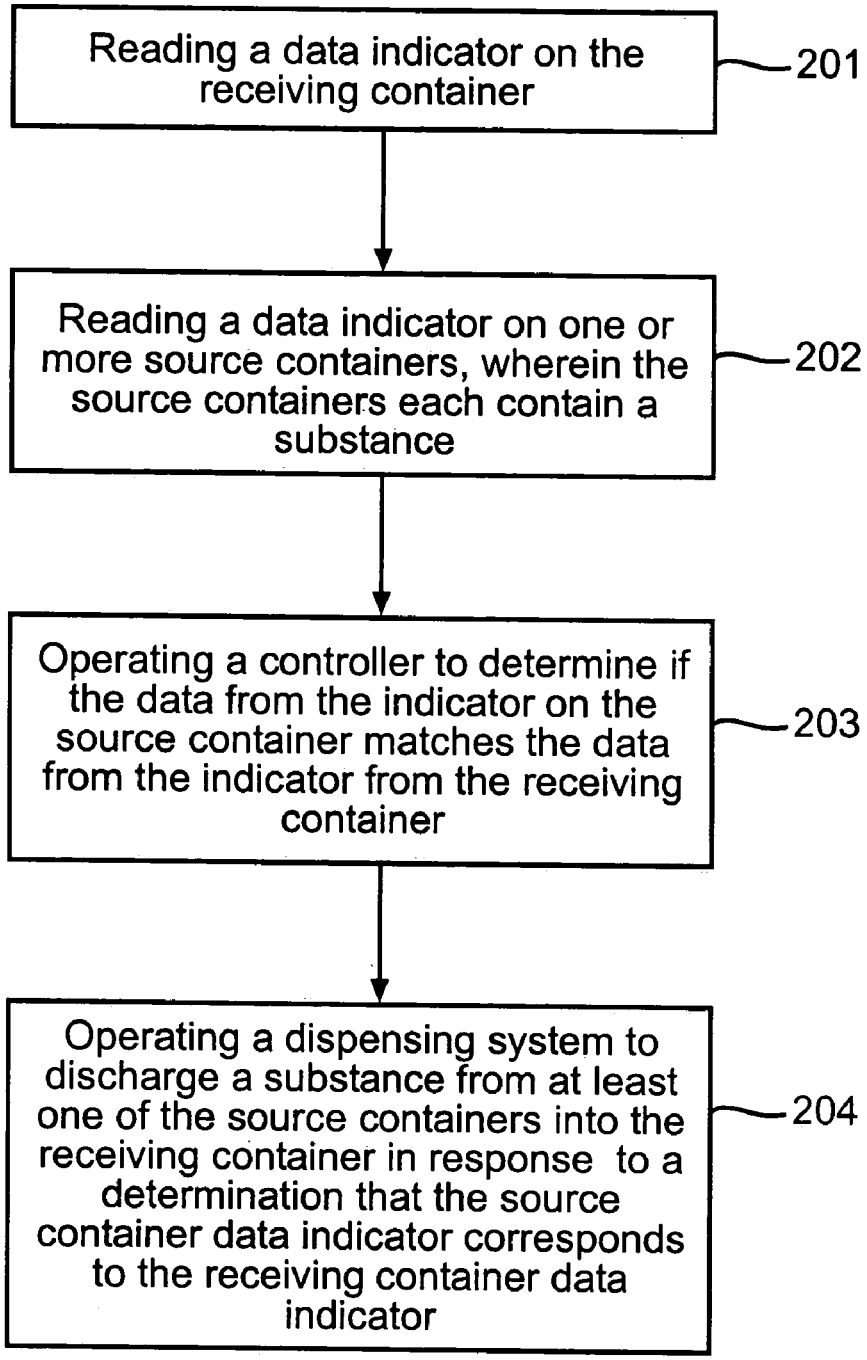
FIG. 7 is a process diagram of the steps of the method of operating the apparatus of the present invention.

Shown in FIG. 7 is a flow chart depicting the method of operating a dispensing apparatus in accordance with the present invention. The method of dispensing a substance into a receiving container includes: in a first step 201 (*a*) reading a data indicator on the receiving container; in a second step 202 (*b*) reading a data indicator on one or more source containers, wherein the source containers each contain a substance; in a third step 203 (*c*) operating a controller to determine if the data from the indicator on the source container matches the data from the indicator from the receiving container; and in a fourth step 204 (*d*) operating a dispensing system to discharge a substance from at least one of the source containers into the receiving container in response to a determination that the source container data indicator corresponds to the receiving container data indicator. The controller is programmed to determine when a dispensing condition is satisfied, based on the data from the receiving container, and to generate a signal when the dispensing condition is satisfied. The dispenser is configured to discharge the substance into the receiving container in response to the signal from the controller.

The method can optionally include, individually or jointly, the steps of: (e) operating the controller to dispense an amount of the substance based on data contained on the data indicator; (f) operating the controller to record the amount of the substance discharged, the number of receiving containers filled, the frequency with which receiving containers are filled, and the number of discharges made from the source container; (g) operating the controller to record at least one of the total amount of the substance discharged and the amount of the substance discharged per operation of the dispensing system; (h) operating the controller to limit the frequency with which receiving containers can be filled; (i) operating the controller to communicate the recorded data to a master control device; and (j) operating a mechanism for personnel identification such that the dispensing system is operable only when the system recognizes the personnel as being authorized.

The principle and mode of operation of this invention have been described in its preferred embodiments. However, it should be noted that this invention may be practiced otherwise than as specifically illustrated and described without departing from its scope.

What is claimed is:

1. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when a dispensing condition is satisfied, based on the data from the receiving container, and to generate a signal when the dispensing condition is satisfied, wherein the receiving container data indicator indicates the position of the receiving container with respect to the source container and the dispensing condition is satisfied when the receiving container is properly positioned; and a dispenser for discharging the substance into the receiving container in response to the signal from the controller.

2. The apparatus of claim 1 wherein the dispensing condition is a match between data from the data indicator and data stored for access by the controller.

3. The apparatus defined in claim 1 wherein the dispenser is adapted to dispense a plurality of substances from a plurality of source containers.

4. The apparatus defined in claim 1 further being adapted to mix diluent with the substance and discharge a mixture of the diluent and substance into the receiving container.

5. The apparatus defined in claim 1 further comprising a plurality of source containers each containing a substance, wherein the apparatus is adapted to mix two or more substances and discharge a mixture of the substances into the receiving container.

6. The apparatus defined in claim 1 in combination with a substance that is a chemical concentrate.

7. The apparatus defined in claim 1 in combination with a substance that is one of a liquid, a powder, and a solid.

8. The apparatus defined in claim 1 in combination with one or more receiving containers.

9. A dispensing apparatus comprising:

a plurality of source containers each containing a substance, wherein each of the source containers has at least one data indicator containing data;

a reading mechanism capable of reading the data on the source container data indicators and data from a receiving data indicator on a receiving container for receiving the substance and transmitting the data to a controller; and a controller programmed to process the data received from the source container data indicators and receiving container data indicator, and to operate at least one of the source containers to discharge the one or more substance into the receiving container in response to a determination that the data from the receiving container data indicator matches data from the at least one source container data indicator.

10. The apparatus defined in claim 9 wherein the apparatus is configured to accept source containers of different sizes so that a source container can be replaced with a differently sized source container.

11. The apparatus defined in claim 9 further comprising a mechanism for personnel identification, and wherein the controller is programmed to discharge a substance from a source container only when data from the personnel identification mechanism matches stored data indicating authorized operating personnel.

12. The apparatus defined in claim 9 wherein the controller is programmed to record at least one of the amount of the substance dispensed, the number of receiving containers filled, and the frequency with which receiving containers are filled.

13. The apparatus defined in claim 12 wherein the controller is programmed to record at least one of the total amount of substance dispensed, and the amount of substance dispensed at a time.

14. The apparatus defined in claim 9 wherein the controller is programmed to track the frequency of filling the receiving container and the controller is programmed to limit the frequency with which the receiving container can be filled.

15. The apparatus defined in claim 9 wherein the controller is adapted to communicate data to a master control device.

16. The apparatus defined in claim 9 wherein the reading mechanism is movable with respect to the apparatus.

17. The apparatus defined in claim 16 wherein the reading mechanism is a scanner gun.

18. The apparatus defined in claim 9 wherein the reading mechanism is an RF receiver and the receiving container data indicator is an RF chip.

19. The apparatus defined in claim 9 further being adapted to mix diluent with the substance and discharge a mixture into the container.

20. The apparatus defined in claim 9 further being adapted to mix multiple substances and dispense a mixture into the container.

21. The apparatus defined in claim 9 wherein the controller is programmed to track the frequency of filling the receiving container.

22. The apparatus defined in claim 9 wherein the controller is programmed to limit the frequency with which the receiving container can be filled.

23. An apparatus for dispensing a substance comprising:

a source container containing the substance, wherein the substance is a chemical concentrate;

a dispenser connected to the source container that is adapted to dispense the chemical concentrate from the source container;

a data indicator connected to the source container, wherein the data indicator identifies data about the chemical concentrate contained in the source container;

a reading mechanism capable of reading the data from the source container data indicator and the data from a data indicator on a receiving container, wherein the receiving container data indicator identifies data about the receiving container; and a controller connected to the reading mechanism and the dispenser, wherein the controller is programmed to operate the dispenser to dispense the chemical concentrate from the source container when data on the source container data indicator corresponds to the data on the receiving container data indicator.

24. A container filling apparatus comprising:

at least one source container containing a substance, the source container having a source data indicator containing data;

a reading mechanism capable of reading data from a data indicator on a receiving container, wherein the data indicator identifies data about the receiving container;

a controller connected to the reading mechanism, the controller being programmed to determine when there is a match between data from the source data indicator and data from a personnel identification indicator, and to generate a signal when there is a match; and a dispenser for discharging the substance into the receiving container in response to the signal from the controller.

25. The apparatus defined in claim 24 wherein the controller is programmed to limit the amount of the substance dispensed per operation of the dispenser, the number of receiving containers processed, and the frequency of receiving container filling based on program parameters of the controller.

26. The apparatus defined in claim 24 wherein the controller is programmed to record at least one of the amount of substance discharged per operation of the dispenser, the number of receiving containers processed, and the frequency with which receiving containers are filled.

27. The apparatus defined in claim 26 wherein the dispensing condition is satisfied when an operator data indicator matches at least one of the source container data indicator and receiving container data indicator, wherein the operator data indicator contains personnel information pertaining to an operator.

28. The apparatus defined in claim 24 wherein the controller is programmed to record the personnel information about the operator operating the apparatus.

29. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when there is a match between data from the data indicator on the receiving container and data from a personnel identification indicator, and to generate a signal when there is a match; and a dispenser for discharging the substance into the receiving container in response to the signal from the controller.

30. The apparatus defined in claim 29 wherein the controller is programmed to limit the amount of the substance dispensed per operation of the dispenser, the number of receiving containers processed, and the frequency of receiving container filling based on program parameters of the controller.

31. The apparatus defined in claim 29 wherein the controller is programmed to record at least one of the amount of substance discharged per operation of the dispenser, the number of receiving containers processed, and the frequency with which receiving containers are filled.

32. The apparatus defined in claim 31 wherein the dispensing condition is satisfied when an operator data indicator matches at least one of the source container data indicator and receiving container data indicator, wherein the operator data indicator contains personnel information pertaining to an operator.

33. The apparatus defined in claim 29 wherein the controller is programmed to record the personnel information about the operator operating the apparatus.

34. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when a dispensing condition is satisfied, based on the data from the receiving container, and to generate a signal when the dispensing condition is satisfied; and a dispenser for discharging the substance into the receiving container in response to the signal from the controller;

wherein the receiving container data indicator indicates the position of the receiving container with respect to the source container and the dispensing condition is satisfied when the receiving container is properly positioned; and wherein the controller is programmed to limit the amount of the substance dispensed per operation of the dispenser.

35. The apparatus defined in claim 34 wherein the controller is programmed to record the amount of substance discharged per operation of the dispenser.

36. The apparatus defined in claim 35 wherein the dispensing condition is additionally satisfied when an operator data indicator matches at least one of a data indicator on the source container and the receiving container data indicator, wherein the operator data indicator contains personnel information pertaining to an operator.

37. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when a dispensing condition is satisfied, based on the data from the receiving container, and to generate a signal when the dispensing condition is satisfied; and a dispenser for discharging the substance into the receiving container in response to the signal from the controller, wherein the receiving container data indicator indicates the position of the receiving container with respect to the source container and the dispensing condition is satisfied when the receiving container is properly positioned; and wherein the controller is programmed to record at least one of:

the amount of substance discharged per operation of the dispenser;

the number of receiving containers processed; and the frequency with which receiving containers are filled.

38. The apparatus defined in claim 37 wherein the dispensing condition is additionally satisfied when an operator data indicator matches at least one of a data indicator on the source container and the receiving container data indicator, wherein the operator data indicator contains personnel information pertaining to an operator.

39. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when a dispensing condition is satisfied, based on the data from the receiving container, and to generate a signal when the dispensing condition is satisfied; and a dispenser for discharging the substance into the receiving container in response to the signal from the controller;

wherein the controller is programmed to record personnel information about the operator operating the apparatus.

40. A container filling apparatus comprising:

multiple source containers containing substances;

a reading mechanism capable of reading data from multiple data indicators on a receiving container, wherein the data indicators identify data about the receiving container;

a controller connected to the reading mechanism, the controller being programmed to determine when a dispensing condition is satisfied, based on the data from the receiving container, and to generate a signal when the dispensing condition is satisfied; and a dispenser for discharging the substances from the multiple source containers into the receiving container in response to the signal from the controller;

wherein each source container has a data indicator and each of the multiple data indicators can be used to associate the receiving container with one of the multiple source containers.

41. A container filling apparatus comprising:

at least one source container containing a substance;

a reading mechanism capable of reading a locating mechanism on a receiving container, wherein the data indicator identifies data about the receiving container;

a dispenser connected to the source container to discharge the substance from the source container;

a controller connected to the reading mechanism, the controller being programmed to determine when the receiving container is properly positioned with respect to the dispenser based on data from the data indicator, and to generate a signal when the receiving container is properly positioned; and a dispenser for discharging the substance into the receiving container in response to the signal from the controller.

42. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when a dispensing condition is satisfied, based on the data from the receiving container, and to generate a signal when the dispensing condition is satisfied; and a dispenser for discharging the substance into the receiving container in response to the signal from the controller;

wherein the receiving container data indicator indicates the position of the receiving container with respect to the source container and the dispensing condition is satisfied when the receiving container is properly positioned; and wherein the controller is programmed to limit the number of receiving containers processed.

43. A container filling apparatus comprising:

at least one source container containing a substance;

a reading mechanism capable of reading data from a data indicator on a receiving container, wherein the data indicator identifies data about the receiving container;

a controller connected to the reading mechanism, the controller being programmed to determine when a dispensing condition is satisfied, based on the data from the receiving container, and to generate a signal when the dispensing condition is satisfied; and a dispenser for discharging the substance into the receiving container in response to the signal from the controller;

wherein the receiving container data indicator indicates the position of the receiving container with respect to the source container and the dispensing condition is satisfied when the receiving container is properly positioned; and wherein the controller is programmed to limit the frequency of filling the receiving containers.

44. A container filling apparatus comprising:

at least one source container containing a substance;

a reading mechanism capable of reading data from a data indicator on the at least one source container, wherein the data indicator identifies data about the source container;

a controller connected to the reading mechanism, the controller being programmed to determine when there is a match between data from the data indicator on the source container and data from a personnel identification indicator, and to generate a signal when there is a match; and a dispenser for discharging the substance into a receiving container in response to the signal from the controller.

* * * * *